US009944374B1

(12) United States Patent
Anderson et al.

(10) Patent No.: US 9,944,374 B1
(45) Date of Patent: Apr. 17, 2018

(54) OUTBOARD MOTORS AND OIL PICKUP DEVICES FOR OUTBOARD MOTORS

(71) Applicant: Brunswick Corporation, Lake Forest, IL (US)

(72) Inventors: Steven Thomas Anderson, Winneconne, WI (US); Nathan C. King, Fond du Lac, WI (US); David J. Belter, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 15/609,247

(22) Filed: May 31, 2017

(51) Int. Cl.

| | |
|---|---|
| ***B63H 20/00*** | (2006.01) |
| ***B63H 21/38*** | (2006.01) |
| ***F01M 11/02*** | (2006.01) |
| ***F01M 11/00*** | (2006.01) |
| ***F02B 61/04*** | (2006.01) |

(52) U.S. Cl.
CPC ..... *B63H 20/002* (2013.01); *F01M 11/0004* (2013.01); *F02B 61/045* (2013.01); *B63B 2758/00* (2013.01); *F01M 2011/007* (2013.01)

(58) Field of Classification Search
CPC ... B63H 20/002; F02B 61/045; F01M 11/065; F01M 11/0004; F01M 2011/007; F01M 2011/0075; B63B 2758/00
See application file for complete search history.

(56) References Cited

U.S. PATENT DOCUMENTS

| | | | | |
|---|---|---|---|---|
| 1,800,585 | A * | 4/1931 | Woolson | B01D 35/027 210/167.02 |
| 4,709,671 | A * | 12/1987 | Sumigawa | F01M 1/16 123/196 S |
| 4,828,519 | A * | 5/1989 | Watanabe | F02B 61/045 440/49 |
| 5,975,042 | A * | 11/1999 | Aizawa | F01M 1/04 123/196 CP |
| 7,850,496 | B1 | 12/2010 | Eichinger | |
| 8,668,538 | B1 | 3/2014 | Langenfeld et al. | |
| 9,174,818 | B1 | 11/2015 | Langenfeld et al. | |
| 9,228,455 | B1 | 1/2016 | Belter et al. | |
| 9,481,434 | B1 | 11/2016 | Eichinger et al. | |
| 9,616,987 | B1 | 4/2017 | Langenfeld et al. | |

* cited by examiner

*Primary Examiner* — Ajay Vasudeva
(74) *Attorney, Agent, or Firm* — Andrus Intellectual Property Law, LLP

(57) ABSTRACT

An outboard motor has an internal combustion engine and a sump with an interior for holding oil for the internal combustion engine. The interior is defined by a top, a bottom, and sidewalls that extend from the top to the bottom. At least a portion of the sidewalls tapers radially inwardly towards the bottom. An oil pickup conduit extends into the interior and is configured to convey oil from the sump to the internal combustion engine. A bumper is disposed on the oil pickup conduit and separates the oil pickup conduit from the sidewall.

13 Claims, 4 Drawing Sheets

OUTBOARD MOTORS AND OIL PICKUP DEVICES FOR OUTBOARD MOTORS

FIELD

The present disclosure relates to outboard motors and particularly to oil sumps and oil pickup devices for outboard motors.

BACKGROUND

The following U.S. Patents are incorporated herein by reference.

U.S. Pat. No. 9,481,434 discloses a mid-section housing for an outboard motor that includes a driveshaft housing having an oil sump provided therein. An adapter plate is coupled to a top of the driveshaft housing. The adapter plate has an inner surface along which oil from an engine mounted on the adapter plate drains into the oil sump. First and second pockets are formed in an outer surface of the adapter plate on first and second generally opposite sides thereof, the first and second pockets configured to receive first and second mounts therein. A water jacket is formed between the inner and outer surfaces of the adapter plate. The water jacket extends at least partway between the inner surface of the adapter plate and each of the first and second pockets, respectively. A method for cooling a mount is also provided.

U.S. Pat. No. 9,228,455 discloses a marine engine for an outboard motor that comprises a bank of piston-cylinders, an intake camshaft that operates intake valves for controlling inflow of air to the bank of piston-cylinders, an exhaust camshaft that operates exhaust valves for controlling outflow of exhaust gas from the bank of piston-cylinders, and a cam phaser disposed on one of the intake camshaft and exhaust camshaft. The cam phaser is connected to and adjusts a timing of operation of the other of the intake camshaft and exhaust camshaft with respect to the one of the intake camshaft and exhaust camshaft U.S. Pat. Nos. 8,668,538 and 9,616,987 and 9,174,818 disclose a marine engine including a cylinder block having first and second banks of cylinders that are disposed along a longitudinal axis and extend transversely with respect to each other in a V-shape so as to define a valley there between. A catalyst receptacle is disposed at least partially in the valley and contains at least one catalyst that treats exhaust gas from the marine engine. A conduit conveys the exhaust gas from the marine engine to the catalyst receptacle. The conduit receives the exhaust gas from the first and second banks of cylinders and conveys the exhaust gas to the catalyst receptacle. The conduit reverses direction only once with respect to the longitudinal axis.

U.S. Pat. No. 7,850,496 discloses a lubrication draining and filling system that provides oil passages that direct a flow of liquid oil from a bottom region of an oil sump, located within a rotatable portion of the marine propulsion system, to a discharge port which is connectable in fluid communication with a device that can sufficiently lower the pressure at the discharge port to induce the upward flow of oil from the lower portion of the oil sump within the gear case. The cavity of the oil sump within the gear case is disposed within a rotatable portion of the marine propulsion device while the discharge port is located within a stationary portion of the marine propulsion device. A transitional region comprises a space located between the stationary and rotatable portions. The oil can therefore flow from a rotatable portion, into the space, and then from the space into the stationary portion which allows it to be removed from the marine propulsion device.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter. In certain examples, an outboard motor has an internal combustion engine and a sump with an interior for holding oil for the internal combustion engine. The interior is defined by a top, a bottom, and sidewalls that extend from the top to the bottom. At least a portion of the sidewalls tapers radially inwardly towards the bottom. An oil pickup conduit extends into the interior and is configured to convey oil from the sump to the internal combustion engine. A bumper is disposed on the oil pickup conduit and separates the oil pickup conduit from the sidewall.

DETAILED DESCRIPTION OF THE DRAWINGS

Figure 1:
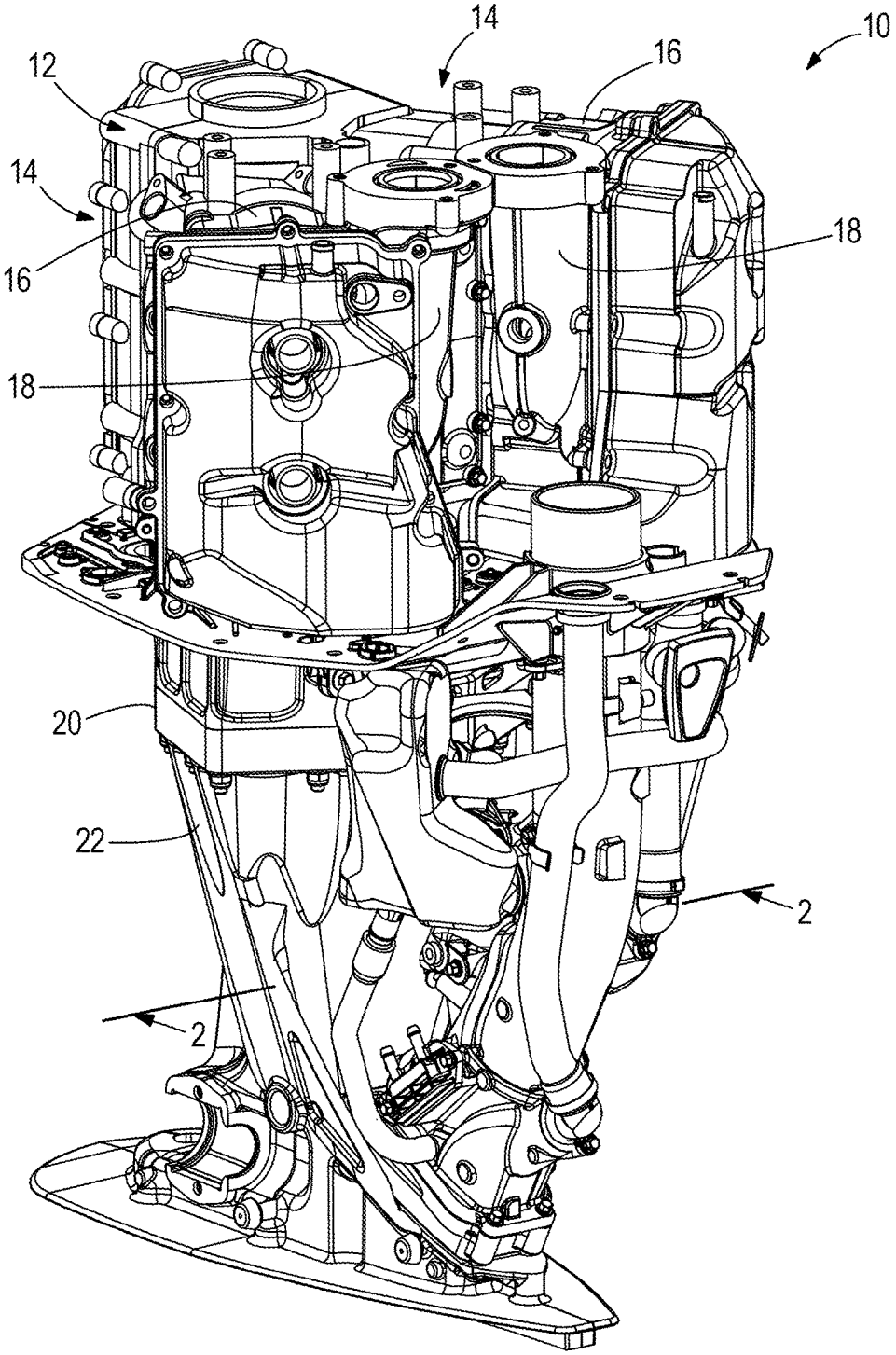
FIG. 1 is a perspective view of an outboard motor.

FIGS. 1-5 depict portions of an outboard motor 10 having an internal combustion engine 12. In the illustrated example, the internal combustion engine 12 is a V-style engine, similar to the embodiments described in the above-incorporated U.S. Pat. Nos. 8,668,538 and 9,616,987 and 9,174,818. The V-style engine has two banks 14 of vertically-aligned cylinders that extend from each other in a V-shape. A pair of cylinder heads 16 is disposed on the two banks of cylinders 14. The cylinder heads 16 can be configured in a manner similar to the above-incorporated U.S. Pat. No. 9,481,434. Exhaust gas from the combustion process is discharged inside of the V-shape via exhaust manifolds 18, as disclosed in the above-incorporated U.S. Pat. Nos. 8,668,538 and 9,616,987 and 9,174,818. The configuration of the internal combustion engine 12 is not critical to the various inventive concepts disclosed herein. For example, instead of a V-style configuration, the internal combustion could have an in-line configuration. The number of cylinders can also vary from what is shown.

Figure 4:
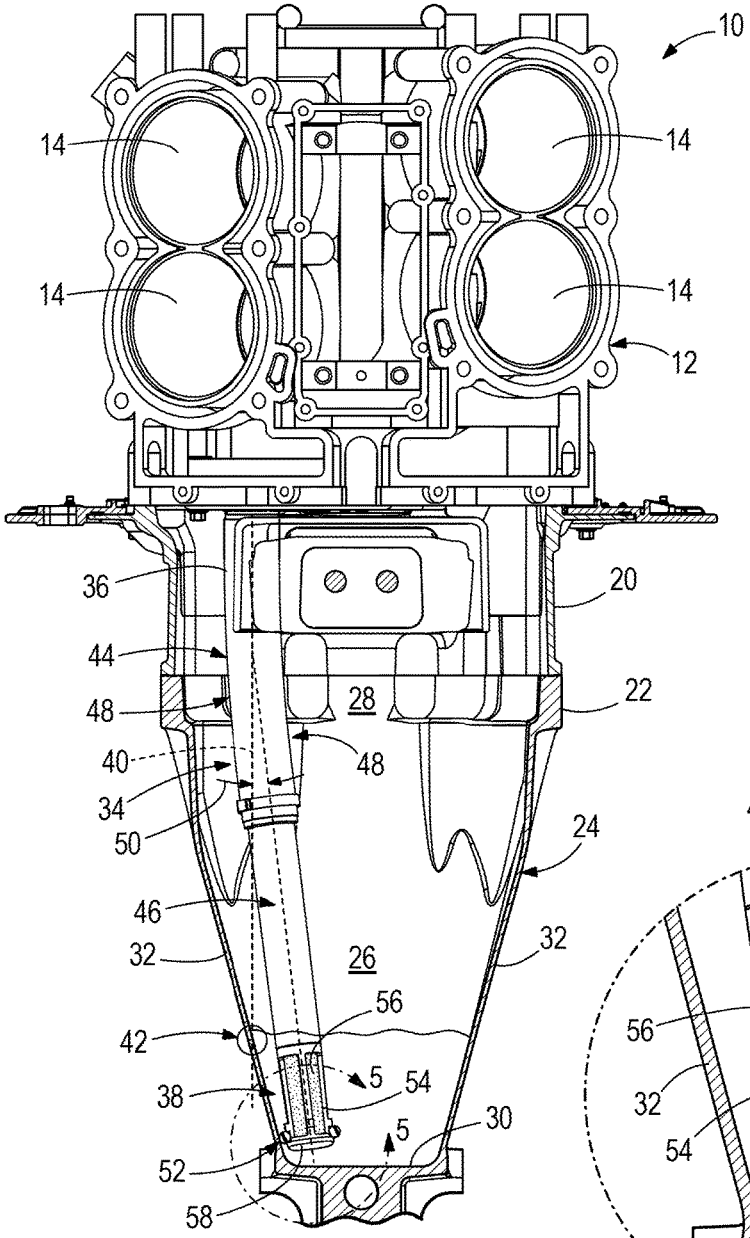
FIG. 4 is a vertical section view of the outboard motor.

The internal combustion engine 12 is supported with respect to the transom of a marine vessel via an underlying adapter plate 20. The particular configuration of the adapter plate 20 can also vary from what is shown in the drawings. A driveshaft housing 22 extends below the adapter plate 20 and defines an oil sump 24 for containing oil for lubrication of the internal combustion engine 12. The oil sump 24 has an interior 26 that is defined by an open top 28, a bottom 30, and peripheral sidewalls 32 that extend from the top 28 to the bottom 30. As best shown in FIG. 4, the lower portions of the sidewalls 32 are tapered radially inwardly towards the bottom 30. An oil pickup conduit 34 extends into the interior 26 and is configured to convey oil from the oil sump 24 to the internal combustion engine 12. The oil pickup conduit 34 has a fixed upper end 36 that is coupled to an oil pump 57, and a free lower end 38 that is located proximate to the bottom 30 of the oil sump 24. As best shown in FIG. 4, the oil pickup conduit 34 is positioned with respect to the oil sump 24 so that the fixed upper end 36 is located closer to one side of the oil sump 24 (the left side in FIG. 4) than an opposite side of the sump 24 (the right side in FIG. 4). The fixed upper end 36 of the oil pickup conduit 34 has a center axis 40 that intersects the lower portion of the left sidewall 32 of the sump 24, which tapers radially inwardly towards the bottom 30. See the intersection point 42 in FIG. 4.

Referring to FIG. 4, the oil pickup conduit 34 has flexible sidewalls 44 at the fixed upper end 36 and rigid sidewalls 46 at the free lower end 38. Thus, the oil pickup conduit 34 is free to bend (see bend generally at 48) along the flexible sidewalls 44. This is further illustrated in FIG. 3, which is a view from above the oil sump 24. Because of the bend 48, the rigid sidewalls 46 extend at an angle 50 with respect to the flexible sidewalls 44 and particularly with respect to the center axis 40 of the fixed upper end 36. The flexible sidewalls 44 can be made of a flexible polymer and the rigid sidewalls 46 made of a rigid material such as metal or a polymer.

Figure 5:
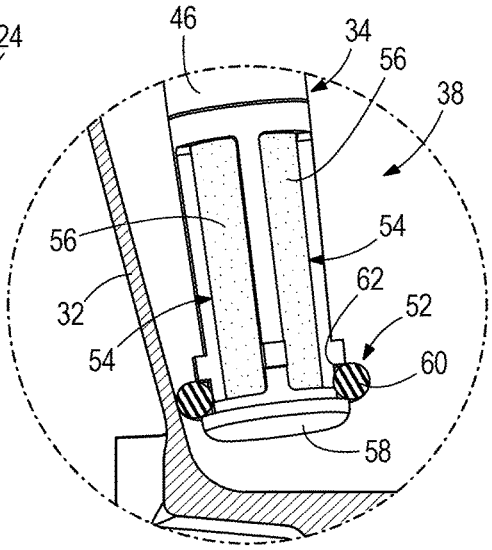
FIG. 5 is a view of Section 5-5, taken in FIG. 4.

Referring to FIGS. 4 and 5, a bumper 52 is disposed on the free lower end 38 of the oil pickup conduit 34. The bumper 52 is configured to separate the free lower end 38 from the inwardly tapered sidewalls 32 of the sump 24. The oil pickup conduit 34 has four oil pickup windows 54 that are radially spaced apart from each other, peripherally around the rigid sidewalls 46 at the free lower end 38. A screen 56 is provided on each oil pickup window 54. The screen 56 is configured to filter solid materials from the oil as the oil flows into the oil pickup conduit 34 via the oil pickup windows 54 from the interior 26 of the sump 24. The free lower end 38 of the oil pickup conduit 34 has a closed end wall 58 and the bumper 52 is located between the oil pickup windows 54 and the closed end wall 58. In the illustrated example, the bumper includes an O-ring 60 that is seated in an O-ring groove 62 on the oil pickup conduit 34. The size of the O-ring 60 can vary. In some examples, the O-ring 60 maintains about a nine millimeter distance from the sidewalls 32 to the pickup screen 56.

Figure 2:
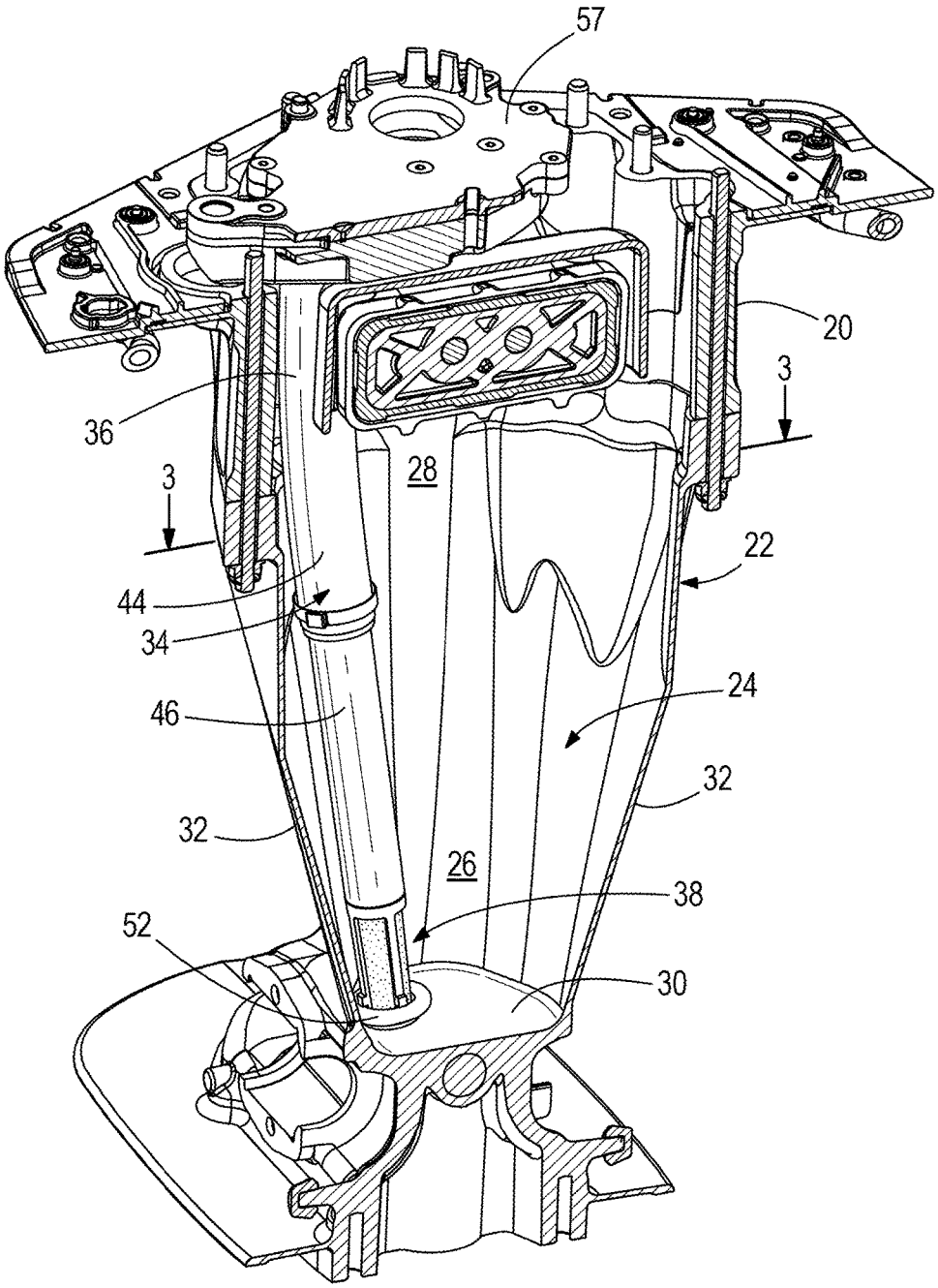
FIG. 2 is a view of Section 2-2, taken in FIG. 1.
Figure 3:
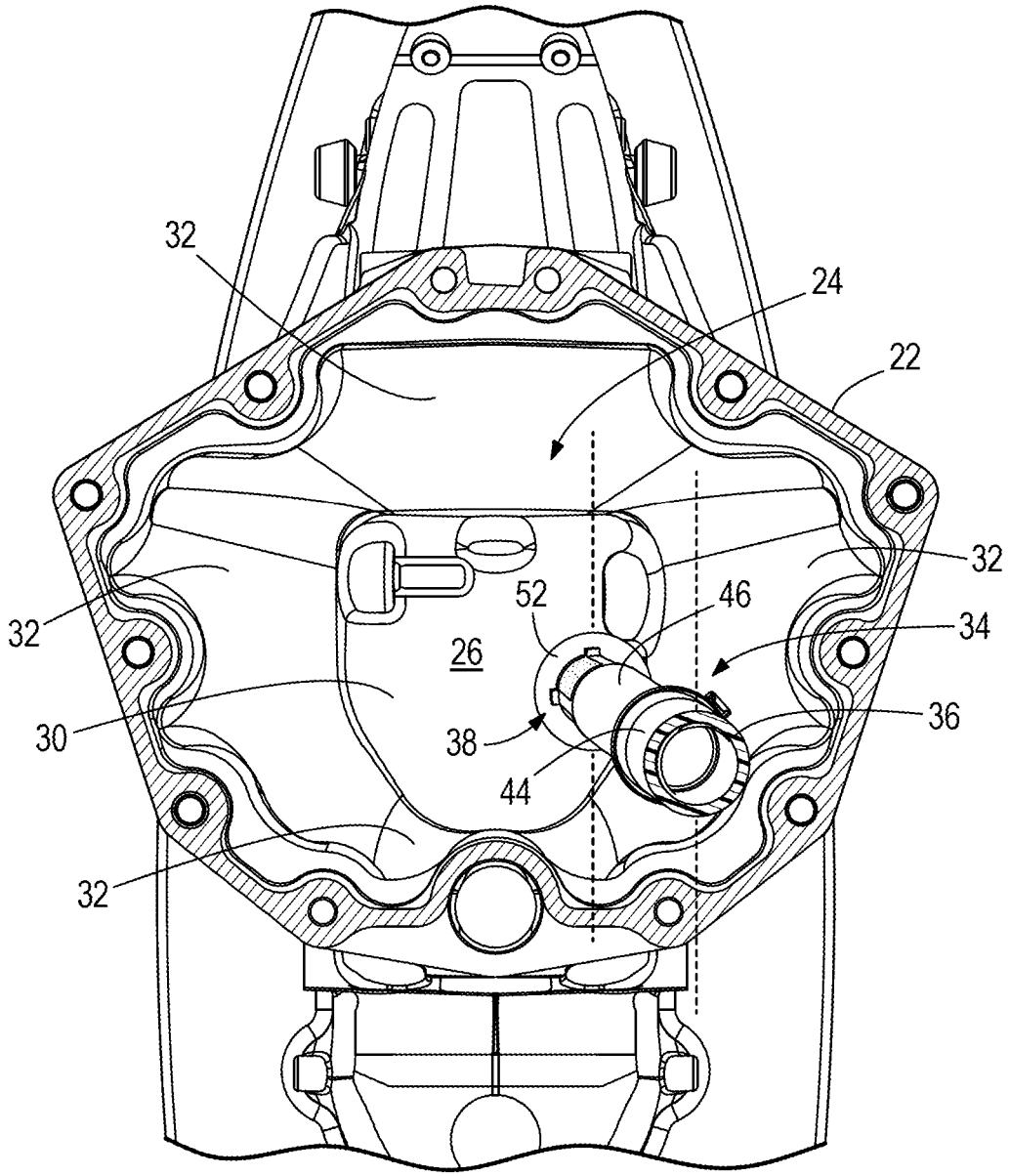
FIG. 3 is a view of Section 3-3, taken in FIG. 2.

Referring to FIG. 2, the oil pump 57 is located at or above the adapter plate 20 and/or coupled to the cylinder block of the internal combustion engine 12. In use, the pump 57 pumps the oil from the interior 26 of the oil sump 24 to the internal combustion engine 12. The oil is caused by the pump 57 to enter the free lower end 38 of the oil pickup conduit 34 via the screens 56 on the oil pickup windows 54, and then travel under the suction force of the pump 57 from the free lower end 38 to the fixed upper end 36 and then on to the internal combustion engine 12.

The oil pickup conduit 34 is located off-center with respect to the interior 26 of the oil sump 24. See e.g. FIGS. 2-5, wherein the oil pickup conduit 34 is located closer to the sidewalls 32 on the left side of the oil sump 24. Location of the oil pickup conduit 34 closer to one side of the oil sump 24 causes the center axis 40 (FIG. 4) to intersect with the tapered portion of the lower sidewalls 32. Upon discovering this problem, the inventors invented the oil pickup conduit 34 disclosed herein, having the flexible sidewalls 44 at the fixed upper end 36, which facilitate bending at bend 48, which allows extension of the free lower end 38 further down in the oil sump 24, thus promoting improved pickup of oil in the interior 26 proximate to the bottom 30 of the oil sump 24. This advantage can be achieved regardless of any natural deformation occurring in the flexible upper end 36. The bumper 52 advantageously spaces the oil pickup windows 54 from the sidewalls 32, thus facilitating improved inflow of oil from all sides of the free lower end 38, and eliminating potential wear of the free lower end 38 of the oil pickup conduit 34. This unique combination also advantageously does not require the installer to clock/orient the oil pickup conduit 34 when the internal combustion engine 12 is mounted to the midsection, thus providing an easier assembly.

In the present description, certain terms have been used for brevity, clearness, and understanding. No unnecessary limitations are to be implied therefrom beyond the requirement of the prior art because such terms are used for descriptive purposes only and are intended to be broadly construed. The different devices and methods described herein may be used alone or in combination with other devices and methods. Various equivalents, alternatives, and modifications are possible within the scope of the appended claims.

What is claimed is:

1. An outboard motor comprising an internal combustion engine; a sump with an interior for holding oil for the internal combustion engine, wherein the interior is defined by a top, a bottom, and sidewalls that extend from the top to the bottom, wherein at least a portion of the sidewalls tapers radially inwardly towards the bottom; an oil pickup conduit that extends into the interior and is configured to convey oil from the sump to the internal combustion engine; and a bumper disposed on the oil pickup conduit and separating the oil pickup conduit from the sidewall;

wherein the oil pickup conduit comprises a fixed upper end and a free lower end, and wherein the bumper separates the free lower end from the sidewall;

wherein the bumper is located closer to the free lower end than the fixed upper end; and an oil pickup window in a sidewall of the oil pickup conduit, the oil pickup window located closer to the free lower end than the fixed upper end, wherein the oil is conveyed from the sump to the internal combustion engine via the oil pickup window.

2. The outboard motor according to claim 1, wherein the fixed upper end is coupled to an oil pump.

3. The outboard motor according to claim 1, further comprising a screen on the oil pickup window through which the oil flows into the oil pickup conduit from the interior of the sump.

4. The outboard motor according to claim 1, wherein the free lower end comprises a closed end wall.

5. The outboard motor according to claim 4, wherein the bumper is located between the oil pickup window and the closed end wall.

6. The outboard motor according to claim 1, wherein the bumper comprises an O-ring that is seated in an O-ring groove on the oil pickup conduit.

7. An outboard motor comprising an internal combustion engine; a sump with an interior for holding oil for the internal combustion engine, wherein the interior is defined by a top, a bottom, and sidewalls that extend from the top to the bottom, wherein at least a portion of the sidewalls tapers radially inwardly towards the bottom; an oil pickup conduit that extends into the interior and is configured to convey oil from the sump to the internal combustion engine; and a bumper disposed on the oil pickup conduit and separating the oil pickup conduit from the sidewall;

wherein the oil pickup conduit comprises a fixed upper end and a free lower end, and wherein the bumper separates the free lower end from the sidewall;

wherein the bumper is located closer to the free lower end than the fixed upper end;

wherein the oil pickup conduit comprises flexible sidewalls located closer to the fixed upper end than the free lower end and rigid sidewalls located closer to the free lower end than the fixed upper end, and wherein the oil pickup conduit is bent along the flexible sidewalls so that the rigid sidewalls extend at an angle with respect to the fixed upper end; and wherein the flexible sidewalls are made of a flexible polymer and wherein the rigid sidewalls are made of a rigid material.

8. An outboard motor comprising an internal combustion engine; a sump with an interior for holding oil for the internal combustion engine, wherein the interior is defined by a top, a bottom, and sidewalls that extend from the top to the bottom, and wherein at least a portion of the sidewalls tapers radially inwardly towards the bottom; an oil pickup conduit that extends into the interior and is configured to convey oil from the sump to the internal combustion engine, wherein the oil pickup conduit comprises a fixed upper end and a free lower end, and wherein the oil pickup conduit is positioned with respect to the oil sump so that the fixed upper end is located closer to one side of the sump than an opposite side of the sump; and a bumper disposed on the oil pickup conduit and separating the free lower end from the sidewall;

wherein the fixed upper end of the oil pickup conduit extends along a center axis that intersects the portion of the sidewalls that tapers radially inwardly towards the bottom of the sump; and a pickup window located closer to the free lower end than the fixed upper end, wherein oil is conveyed from the sump to the internal combustion engine through the pickup window.

9. The outboard motor according to claim 8, wherein the free lower end comprises a closed end wall.

10. The outboard motor according to claim 9, wherein the oil pickup conduit comprises flexible sidewalls located closer to the fixed upper end than the free lower end and rigid sidewalls located closer to the free lower end than the fixed upper end, and wherein the oil pickup conduit is bent along the flexible sidewalls so that the rigid sidewalls extend at an angle with respect to the center axis of the fixed end.

11. The outboard motor according to claim 10, wherein the bumper is located closer to the free lower end than the fixed upper end.

12. The outboard motor according to claim 11, wherein the bumper comprises an O-ring that is seated in an O-ring groove on the oil pickup conduit.

13. An oil pickup device for an outboard motor comprising an internal combustion engine and a sump with an interior for holding oil for the internal combustion engine, the oil pickup conduit being configured to extend into the interior of the sump and convey oil from the sump to the internal combustion engine, the oil pickup device comprising a fixed upper end, a free lower end, a bumper disposed on the oil pickup conduit and configured to separate the free lower end from a sidewall of the sump, wherein the bumper is located closer to the free lower end than the fixed upper end and an oil pickup window in a sidewall of the oil pickup conduit, the oil pickup window being located closer to the free lower end than the fixed upper end, wherein the oil pickup conduit comprises flexible sidewalls located closer to the fixed upper end than the free lower end and rigid sidewalls located closer to the free lower end than the fixed upper end, and wherein the oil pickup conduit is bent along the flexible sidewalls so that the rigid sidewalls extend at an angle with respect to the fixed upper end.

* * * * *